US010253778B2

(12) United States Patent
Tsutsui

(10) Patent No.: US 10,253,778 B2
(45) Date of Patent: Apr. 9, 2019

(54) VACUUM PUMP

(71) Applicant: SHIMADZU CORPORATION, Kyoto (JP)

(72) Inventor: Shingo Tsutsui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 623 days.

(21) Appl. No.: 14/628,696

(22) Filed: Feb. 23, 2015

(65) Prior Publication Data

US 2015/0275914 A1 Oct. 1, 2015

(30) Foreign Application Priority Data

Mar. 28, 2014 (JP) ..... 2014-069189

(51) Int. Cl.
*F04D 19/00* (2006.01)
*F04D 19/04* (2006.01)
(Continued)

(52) U.S. Cl.
CPC ..... *F04D 19/044* (2013.01); *F04D 17/12* (2013.01); *F04D 17/168* (2013.01); *F04D 19/04* (2013.01);
(Continued)

(58) Field of Classification Search
CPC .... F04D 29/584; F04D 29/5853; F04D 17/12; F04D 17/168
(Continued)

(56) References Cited

U.S. PATENT DOCUMENTS 2,730,297 A * 1/1956 Verhoeff ..... F04D 19/044 415/72
3,832,084 A * 8/1974 Maurice ..... F04D 19/04 384/109
(Continued)

FOREIGN PATENT DOCUMENTS

JP 2004-076622 3/2004
JP 2004-270692 9/2004
(Continued)

OTHER PUBLICATIONS

English translation of Chinese Office Action dated Mar. 16, 2017 for corresponding Chinese Application No. 201410733436.1.
(Continued)

*Primary Examiner* — Christopher S Bobish
(74) *Attorney, Agent, or Firm* — Renner, Otto, Boisselle & Sklar, LLP

(57) ABSTRACT

A vacuum pump comprises a screw groove exhaust section including a rotor cylindrical section and a stator; a base; an inner stator forming an inner gas discharge path between an inner peripheral surface of the rotor cylindrical section and the inner stator; an outer stator forming an outer gas discharge path between an outer peripheral surface of the rotor cylindrical section and the outer stator, and being thermally coupled to the inner stator; a communication opening formed on the rotor, and allowing the outer gas discharge path and the inner gas discharge path to communicate with each other on an upstream side; an exhaust opening discharging the joined gas of the gas passing through the outer gas discharge path and the gas passing through the inner gas discharge path from the screw groove exhaust section toward the exhaust port.

8 Claims, 8 Drawing Sheets

(51) Int. Cl.
*F04D 17/12* (2006.01)
*F04D 17/16* (2006.01)
*F04D 29/58* (2006.01)

(52) U.S. Cl.
CPC ..... *F04D 19/042* (2013.01); *F04D 19/046* (2013.01); *F04D 29/584* (2013.01); *F04D 29/5853* (2013.01)

(58) Field of Classification Search
USPC ..... 417/423.4
See application file for complete search history.

(56) References Cited

U.S. PATENT DOCUMENTS 4,904,155 A * 2/1990 Nagaoka ..... F04D 17/168 222/146.4
4,929,151 A * 5/1990 Long ..... F04D 19/044 415/177
5,116,196 A * 5/1992 Baret ..... F04D 19/044 415/89
5,190,438 A * 3/1993 Taniyama ..... F04C 29/025 415/175
5,924,841 A * 7/1999 Okamura ..... F04D 19/046 415/176
6,599,108 B2 * 7/2003 Yamashita ..... F04D 19/04 417/313
6,672,827 B2 * 1/2004 Yamashita ..... F04D 17/168 415/143
6,779,969 B2 * 8/2004 Nonaka ..... F04D 19/046 415/143
6,793,466 B2 * 9/2004 Miyamoto ..... F04D 19/04 415/177
6,926,493 B1 * 8/2005 Miyamoto ..... F04D 19/042 415/143
9,416,784 B2 * 8/2016 Sakaguchi ..... F04D 19/042
9,964,112 B2 * 5/2018 Yamato ..... F04D 19/042
2012/0207592 A1 * 8/2012 Tsutsui ..... F04D 29/388 415/200
2013/0149105 A1 6/2013 Sakaguchi et al.
2013/0164124 A1 * 6/2013 Ohtachi ..... F04D 19/042 415/183
2013/0309076 A1 * 11/2013 Nonaka ..... F04D 19/042 415/200
2015/0226229 A1 8/2015 Tsutsui
2015/0240822 A1 * 8/2015 Sakaguchi ..... F04D 19/042 415/200
2016/0025096 A1 * 1/2016 Shi ..... F04D 19/042 417/423.1

FOREIGN PATENT DOCUMENTS

WO WO 2012/032863 3/2012
WO WO 2012/032863 A1 3/2012
WO WO 2013/008519 1/2013
WO WO 2014/045438 3/2014

OTHER PUBLICATIONS

English translation of Japanese Office Action dated Oct. 31, 2017 for corresponding Japanese Application No. 2014-069189.

* cited by examiner

VACUUM PUMP

BACKGROUND OF THE INVENTION

1. Field of the Invention

The present invention relates to a vacuum pump that includes a screw groove exhaust unit having a dual exhaust path on inner and outer peripheries.

2. Description of the Related Art

Conventionally, there have been used, for example, vacuum pumps such as a turbo-molecular pump as means for discharging gas inside a process chamber in the process of performing processing inside a high-vacuum process chamber such as a dry etching process or a CVD process in a semiconductor manufacturing process.

In this type of process, a large amount of gas is supplied into a process chamber to increase the speed of the process. In order to improve exhaust performance for discharging a large amount of gas, there is known a structure in which screw stators are arranged on both the outer side and the inner side of a rotor.

An example of conventional turbo-molecular pumps has the following structure.

A rotor includes a rotor shaft and a rotor cylindrical section. A central cylindrical section is disposed on a base. An opening through which the rotor shaft is inserted is formed on the central cylindrical section. An outer screw stator fixed to the base is arranged on the outer side of the rotor cylindrical section. An inner screw stator is arranged on the inner side of the rotor cylindrical section. A through hole for gas path communication which allows the outer screw stator and the inner screw stator to communicate with each other is formed on the rotor cylindrical section. The rotor is driven by a motor which includes a motor rotor disposed on the rotor shaft and a motor stator disposed on the central cylindrical section.

Although not illustrated in WO 2012/032863 A, a cooling jacket for cooling the motor stator is typically disposed on the base. In the above structure, the inner stator is cooled together with the motor stator, and reaction products may be disadvantageously accumulated on the inner screw stator accordingly. When reaction products are accumulated, the diameter of the rotor cylindrical section that has increased due to centrifugal force during driving the pump may be reduced at the time of stopping the pump, and the rotor cylindrical section may adhere to the reaction products accumulated on the inner screw stator, thereby causing trouble in restart of the pump.

When a large amount of gas is discharged when intermittently discharging gas or immediately after starting up the vacuum apparatus, the temperature of the motor stator increases. Thus, the motor stator is cooled by driving the cooling jacket disposed on the lower part of the base. At this point, reaction products rapidly increase, and a large amount of reaction products are accumulated in a gap between the rotor cylindrical section and the inner screw stator. As a result, the pump may be disadvantageously stopped.

SUMMARY OF THE INVENTION

A vacuum pump that discharges gas that has been sucked through a suction opening through an exhaust port, the vacuum pump comprises: a screw groove exhaust section including a rotor cylindrical section and a stator; a base constituting a part of a pump container; a rotor having the rotor cylindrical section; an inner stator forming an inner gas discharge path of the screw groove exhaust section between an inner peripheral surface of the rotor cylindrical section and the inner stator; an outer stator forming an outer gas discharge path of the screw groove exhaust section between an outer peripheral surface of the rotor cylindrical section and the outer stator, and being thermally coupled to the inner stator; a communication opening formed on the rotor, and allowing the outer gas discharge path and the inner gas discharge path to communicate with each other on an upstream side; an exhaust opening discharging the joined gas of the gas passing through the outer gas discharge path and the gas passing through the inner gas discharge path from the screw groove exhaust section toward the exhaust port; and a base cooling device for cooling the base.

Preferably the base has a central cylindrical section and an outer cylindrical section, the inner stator is held on the central cylindrical section with a heat insulator interposed therebetween, and the outer stator is held on the outer cylindrical section with or without a heat insulator interposed therebetween.

Preferably the inner stator and the outer stator are cylindrical members having different diameters, the cylindrical members are thermally connected to each other on a downstream side of the gas discharge paths, and the exhaust opening of the screw groove exhaust section is formed on the thermally connected portion.

Preferably the base has the central cylindrical section and the outer cylindrical section, a motor stator of a motor that drives the rotor to rotate is disposed on the central cylindrical section, and the base cooling device includes a lower base cooling device that cools the central cylindrical section.

Preferably the vacuum pump further comprises a turbine blade exhaust section apart from the screw groove exhaust section. The base cooling device includes an upper base cooling device that cools the turbine blade exhaust section.

Preferably the vacuum pump further comprises a stator heating device. The stator heating device includes a stator heating heater for raising a temperature of the outer stator and a stator heating temperature sensor for detecting the temperature of the outer stator, and adjusts output of the stator heating heater in accordance with a result detected by the stator heating temperature sensor to adjust the temperature of the outer stator and a temperature of the inner stator.

Preferably the stator heating device further includes a thermal conductive member attached to the base with a seal member interposed therebetween, and the stator heating heater and the stator heating temperature sensor are disposed on the thermal conductive member.

Preferably a length in an axial direction of the outer stator and a length in an axial direction of the inner stator are equal to each other in the screw groove exhaust section.

In the present invention, the inner stator and the outer stator are thermally coupled to each other. Thus, heat moves from either one of the stators having a higher temperature to the other stator so as to be heated. As a result, it is possible to suppress accumulation of reaction products on the inner and outer stators.

Such an effect can be achieved in a vacuum pump in which an inner stator and an outer stator are both thermally insulated from a base, a vacuum pump in which either one of the stators is thermally insulated from the base, and a vacuum pump in which both the inner stator and the outer stator are not thermally insulated from the base.

DETAILED DESCRIPTION OF THE EXEMPLARY EMBODIMENTS

First Embodiment (Entire Configuration of Vacuum Pump)

Hereinafter, an embodiment of the present invention will be described with reference to the drawings. In the following description, a turbo-molecular pump will be described as an example of the vacuum pump.

Figure 1:
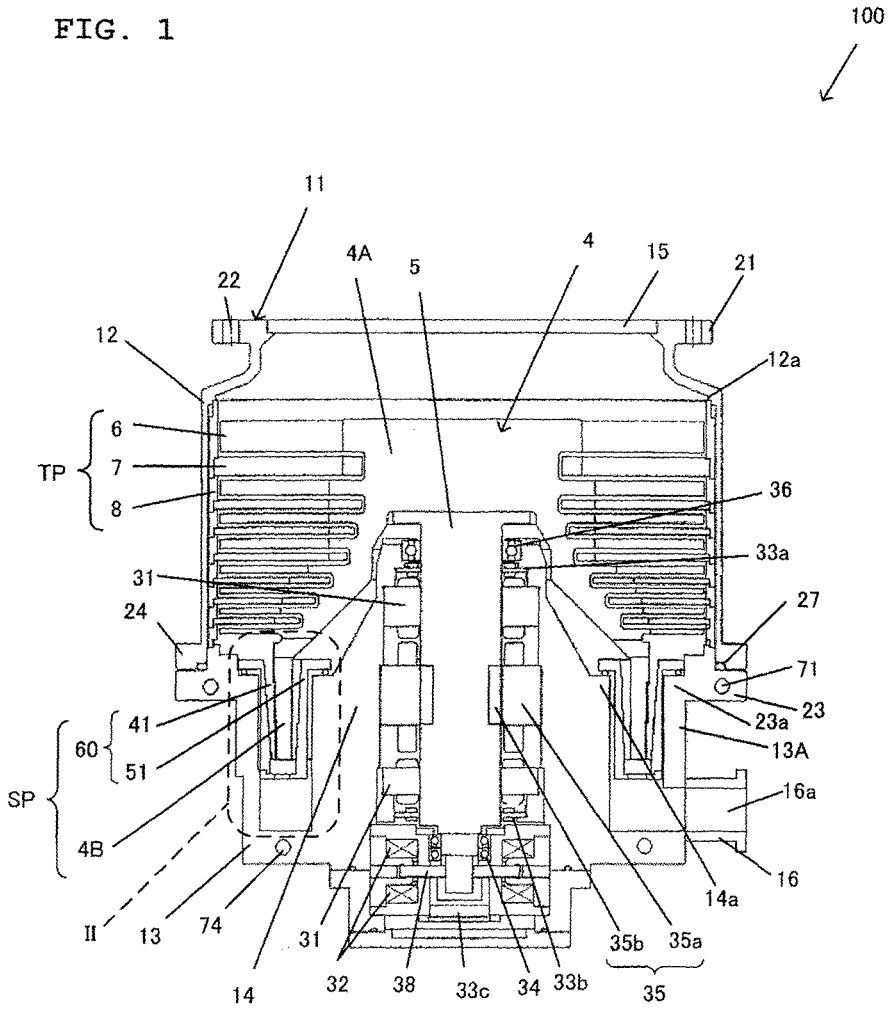
FIG. 1 is a cross-sectional view showing a turbo-molecular pump as an embodiment of a vacuum pump according to the present invention.

FIG. 1 is a cross-sectional view of a turbo-molecular pump 100 according to the present invention.

The turbo-molecular pump 100 is provided with a pump container 11 which includes an upper outer cylinder, i.e., a case member 12, and a base 13 fixed to the case member 12.

The case member 12 has a generally cylindrical shape. The case member 12 is formed of, for example, SUS. An upper flange 21 is formed on the upper end of the case member 12. A circular suction opening 15 is formed on the inner side of the upper flange 21 of the case member 12. The upper flange 21 has bolt insertion through holes 22 which are formed at substantially equal intervals along the circumferential direction. The turbo-molecular pump 100 is attached to an external apparatus such as a semiconductor manufacturing apparatus with bolts (not illustrated) inserted through the through holes 22 of the upper flange 21.

A rotor 4 and a rotor shaft 5 which is coaxially attached to the axis center of the rotor 4 are housed inside the pump container 11. The rotor 4 and the rotor shaft 5 are fixed to each other with bolts (not illustrated).

The rotor 4 includes a rotor upper section 4A and a rotor lower cylindrical section joined to the lower surface of the rotor upper section 4A, i.e., a rotor cylindrical section 4B. The rotor upper section 4A is formed of, for example, an aluminum alloy. A plurality of rotor blades 6 which are radially formed and arrayed in the circumferential direction are arrayed at intervals in the axial direction of the rotor 4 in a plurality of stages on the rotor upper section 4A. The rotor blades 6 are formed at a predetermined inclination angle relative to rotation planes of the rotor blades 6. A plurality of stator blades 7 are arranged between the respective stages of the rotor blades 6.

The stator blades 7 are put between ring-like spacers 8 which are arranged along the inner peripheral surface of the case member 12 and stacked in multiple stages. The upper surface of the uppermost spacer 8 abuts on an inner upper wall 12*a* of the case member 12. The lower surface of the lowermost spacer 8 abuts on a projection 23*a* which is formed on the upper surface of a base upper flange 23 of the base 13. In this manner, the stator blades 7 are supported between the inner upper wall 12*a* of the case member 12 and the upper surface of the projection 23*a* of the base upper flange 23 of the base 13 with an axial force applied thereto through the spacers 8. In this manner, the rotor blades 6 and the stator blades 7 are alternately stacked in multiple stages to construct a high vacuum turbine blade exhaust unit TP.

The base 13 is formed of, for example, an aluminum alloy. The base 13 includes a lower outer cylinder, i.e., a base outer cylinder 13A, and a central cylindrical section 14 which is formed on the central part of the base 13 and has a hollow section formed inside thereof into which the rotor shaft 5 is inserted. A screw groove exhaust unit space is formed between the inner peripheral surface of the base outer cylinder 13A and the outer peripheral surface of the central cylindrical section 14. A screw groove exhaust unit is formed in the screw groove exhaust unit space. The screw groove exhaust unit space has a ring-like shape and communicates with an exhaust port 16. A motor 35, two radial magnetic bearings 31, a pair of upper and lower thrust magnetic bearings 32, radial displacement sensors 33*a*, 33*b*, an axial displacement sensor 33*c*, mechanical bearings 34, 36, and a rotor disk 38 are disposed inside the central cylindrical section 14.

The motor 35 is, for example, a three-phase blushless motor. A motor stator 35*a* of the motor 35 is disposed on the inner peripheral side of the central cylindrical section 14. A motor rotor 35*b* which is provided with a permanent magnet is disposed on the rotor shaft 5.

A screw stator 60 having a double-ring shape is disposed on the inner and outer peripheries of the rotor lower cylindrical section 4B.

The screw stator 60 includes an outer screw stator 41 and an inner screw stator 51. The outer screw stator 41 is arranged between the outer peripheral surface of the rotor lower cylindrical section 4B and the inner peripheral surface of the base 13. The inner screw stator 51 is arranged between the inner peripheral surface of the rotor lower cylindrical section 4B and the outer peripheral surface of the central cylindrical section 14. That is, the screw stator 60 includes the outer screw stator 41 and the inner screw stator 51 which respectively have large and small diameter cylindrical shapes.

A spiral screw groove is formed on either one of the inner peripheral surface of the outer screw stator 41 of the screw stator 60 and the outer peripheral surface of the rotor lower cylindrical section 4B. A screw groove is formed on either one of the outer peripheral surface of the inner screw stator 51 of the screw stator 60 and the inner peripheral surface of the rotor lower cylindrical section 4B. The rotor lower cylindrical section 4B of the rotor 4 and the screw stator 60 together constitute a screw groove exhaust unit SP for low vacuum. An outer gas discharge path is formed between the inner peripheral surface of the outer screw stator 41 and the outer peripheral surface of the rotor lower cylindrical section 4B. An inner gas discharge path is formed between the outer peripheral surface of the inner screw stator 51 of the screw stator 60 and the inner peripheral surface of the rotor lower cylindrical section 4B.

The screw stator 60 will be described in detail below.

The rotor shaft 5 is supported in a contactless manner by the two radial magnetic bearings 31 and the pair of upper and lower thrust magnetic bearings 32. The position of the rotor shaft 5 during rotation is controlled based on a radial-direction position detected by the radial displacement sensors 33*a*, 33*b* and an axial-direction position detected by the axial displacement sensor 33*c*.

The mechanical bearings 34, 36 are emergency mechanical bearings and support the rotor shaft 5 when the magnetic bearings 31, 32 are not operating.

A base upper cooling pipe 71 which forms a base upper cooling path is disposed on the base upper flange 23 which is formed on the upper part of the base 13. A base lower cooling pipe 74 which forms a base lower cooling path is disposed on the lower part of the base 13. Coolant, for example, cooling water flows through the base upper cooling pipe 71 and the base lower cooling pipe 74. These pipes 71, 72 forma cooling passage. Coolant flowing through the base upper cooling pipe 71 cools the rotor 4, specifically, the turbine exhaust unit TP. Cooling water flowing through the base lower cooling pipe 74 cools the motor stator 35*a* of the motor 35 so as to have an appropriate temperature.

The temperature control is performed by adjusting the amount of cooling water flowing through the base upper cooling pipe 71 and the base lower cooling pipe 74 using a valve (not illustrated). In other words, the base upper cooling pipe 71 serves as an upper base cooling device, and the base lower cooling pipe 74 serves as a lower base cooling device.

The exhaust port 16 is disposed on the base 13. An exhaust opening 16*a* is formed on the exhaust port 16. A back pump (not illustrated) is connected to the exhaust port 16. The base 13 has an annular screw groove exhaust unit housing space which houses the screw stator 60 and communicates with the exhaust port 16. In other words, the screw groove exhaust unit SP is formed in the screw groove exhaust unit housing space.

A lower flange 24 of the case member 12 and the base upper flange 23 of the base 13 are fixed to each other with bolts (not illustrated) with a seal member 27 interposed therebetween to construct the pump container 11.

The rotor shaft 5 which is magnetically levitated in a rotatable manner by the magnetic bearings 31, 32 is driven to rotate at high speed by the motor 35. When the rotor shaft 5 is driven to rotate, the rotor 4 coupled to the rotor shaft 5 rotates accordingly. Accordingly, a process gas (hereinbelow, referred to as "gas" appropriately) that has been sucked through the suction opening 15 passes through the turbine blade exhaust unit TP and the screw groove exhaust unit SP, and is then discharged through the exhaust opening 16*a* of the exhaust port 16.

(Screw Stator)

Figure 2:
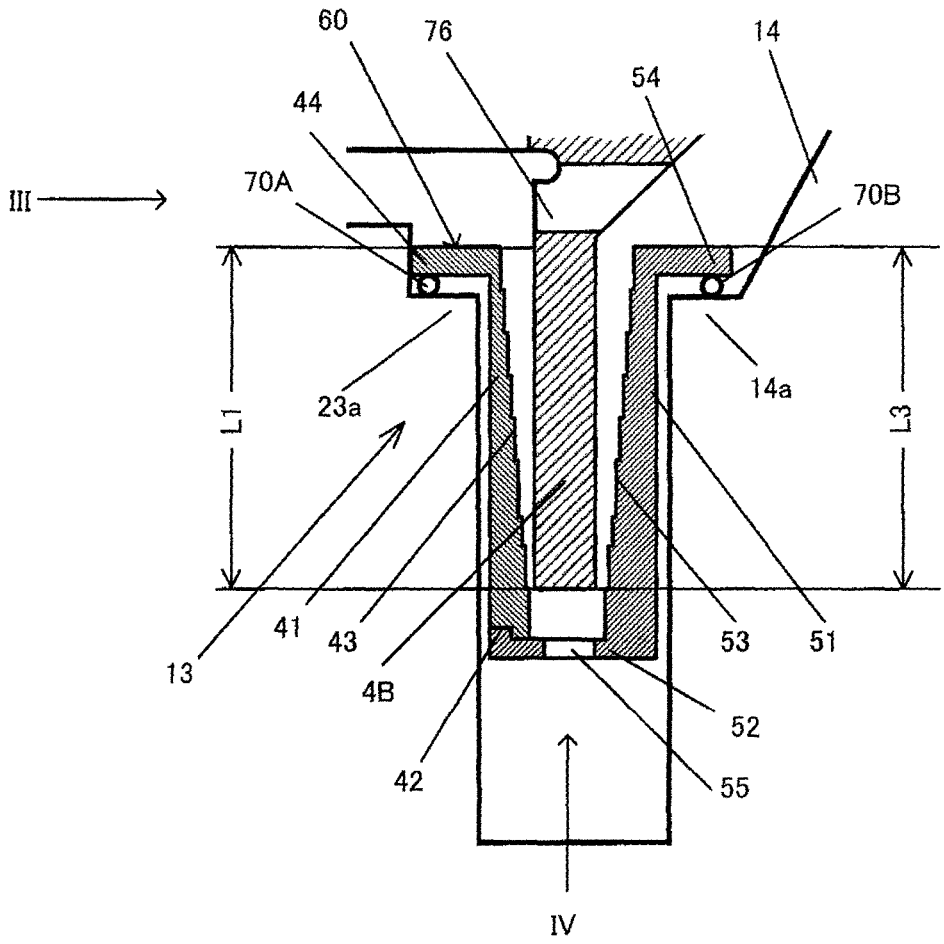
FIG. 2 is an enlarged view of region II of FIG. 1.
Figure 3:
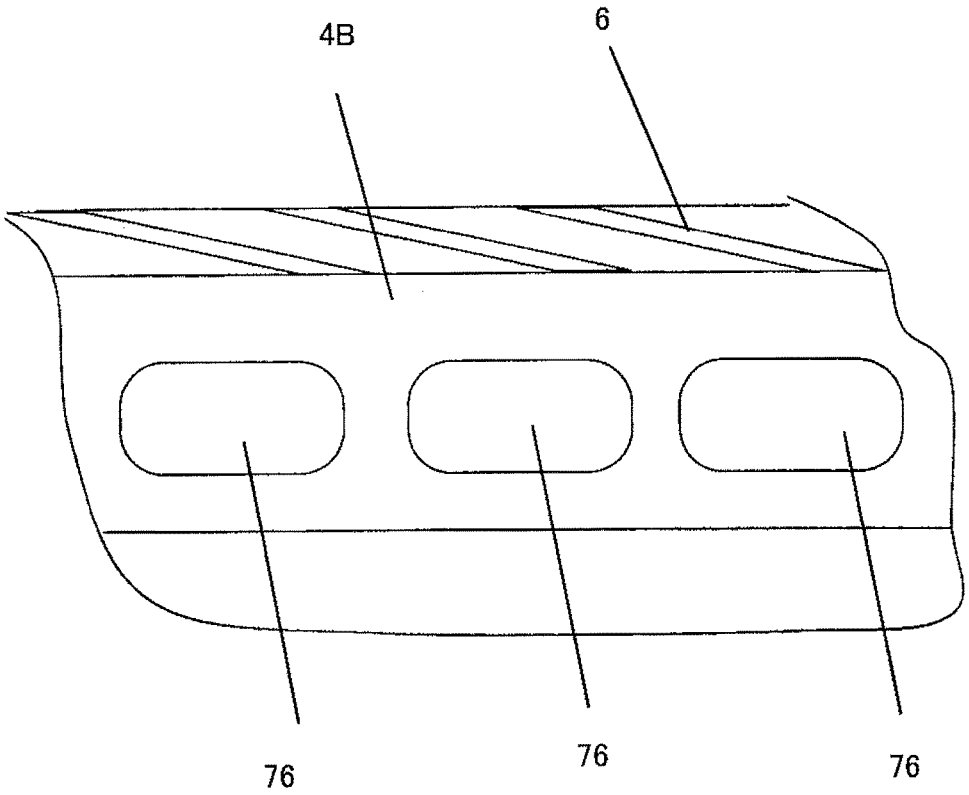
FIG. 3 is an enlarged peripheral side view of a rotor viewed from direction III of FIG. 2.
Figure 4:
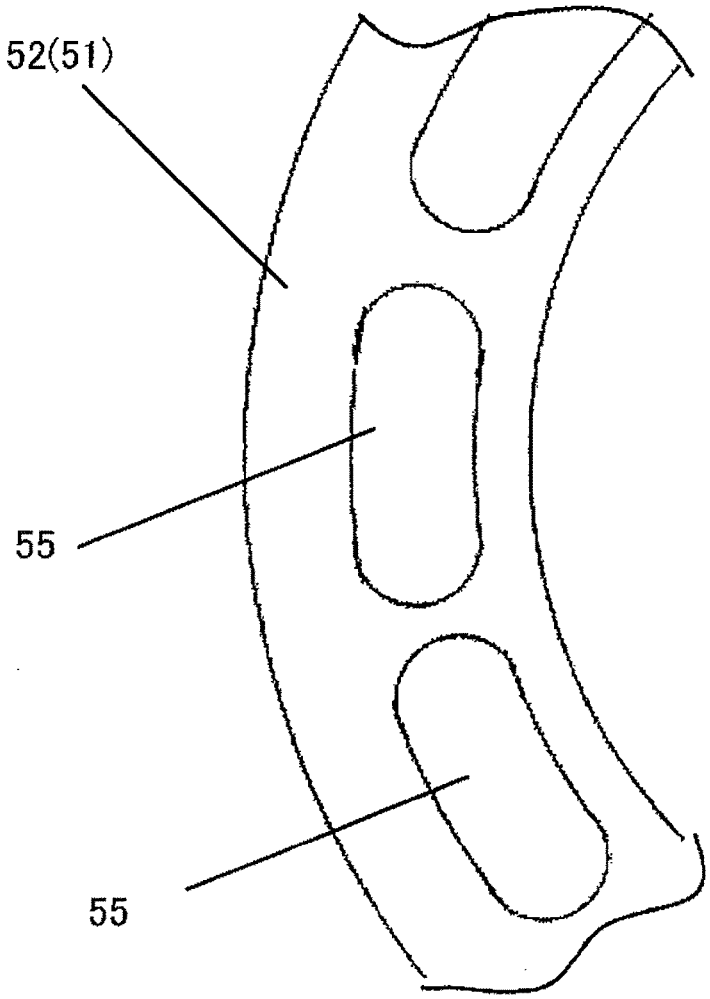
FIG. 4 is a bottom view of a screw stator viewed from direction IV of FIG. 2.

FIG. 2 is an enlarged view of region II of FIG. 1. FIG. 3 is an enlarged peripheral side view of the rotor viewed from direction III of FIG. 2. FIG. 4 is a bottom view of the screw stator viewed from direction IV of FIG. 2.

As described above, the screw stator 60 includes the ring-like outer screw stator 41 and the ring-like inner screw stator 51. A bottom 52 of the inner screw stator 51 extends in the outer peripheral direction, and is thermally coupled to a lower end surface 42 of the outer screw stator 41. Examples of the thermally coupling structure include fixation with a fastening member, for example, a bolt and shrink fitting. Coupling with an adhesive causes a reduction of thermal conductivity, and is thus not preferred. However, the adhesive may be used as long as a predetermined thermal conductivity is ensured.

The outer screw stator 41 has an outer screw groove 43 which is formed on the inner peripheral surface facing the rotor lower cylindrical section 4B and a flange 44 which is formed on the upper part thereof. The flange 44 of the outer screw stator 41 is fixed to the upper surface of the base upper flange 23 of the base 13 with a fastening member (not illustrated) with a heat insulation seal member, i.e., a heat insulator 70A interposed therebetween. That is, the outer screw stator 41 is fixed to the base 13, but thermally insulated from the base 13.

The inner screw stator 51 has an inner screw groove 53 which is formed on the outer peripheral surface facing the rotor lower cylindrical section 4B and a flange 54 which is formed on the upper part thereof. The flange 54 of the inner screw stator 51 is fixed to the upper surface of a step 14*a* which is formed on the middle part in the axial direction of the central cylindrical section 14 of the base 13 with a fastening member (not illustrated) with a heat insulation seal member 70B interposed therebetween. That is, the inner screw stator 51 is fixed to the central cylindrical section 14, but thermally insulated from the central cylindrical section 14.

As the heat insulation seal members 70A, 70B (hereinbelow, also merely referred to as seal members 70), for example, a fluorine O-ring or engineering plastic made of polyetheretherketone (PEEK) may be used.

An aluminum alloy may be used as the material of the outer screw stator 41 and the inner screw stator 51. An aluminum alloy has high thermal conductivity, and is thus capable of accelerating temperature rise. However, an aluminum alloy has high heat dissipation. Thus, in order to increase the temperature of the rotor 4, it is preferred to use stainless steel which has a lower thermal conductivity than an aluminum alloy. An appropriate material may be used corresponding to an upper limit temperature required in the rotor 4.

(Screw Groove Exhaust Unit SP)

The screw stator 60 having the above configuration and the rotor cylindrical section 4B together constitute the screw groove exhaust unit SP. The screw groove exhaust unit SP will be described with reference to FIGS. 1 to 4.

The rotor lower cylindrical section 4B is inserted into the screw groove exhaust unit housing space where the screw stator 60 faces the inner side and the outer side of the rotor lower cylindrical section 4B. The inner gas discharge path is formed between the inner peripheral surface of the rotor lower cylindrical section 4B and the inner screw stator 51 as an inner stator. Similarly, the outer gas discharge path is formed between the outer peripheral surface of the rotor lower cylindrical section 4B and the outer screw stator 41 as an outer stator.

As shown in FIG. 3, a plurality of gas path communication openings 76 are formed on a peripheral wall of the rotor lower cylindrical section 4B. The gas path communication openings 76 allow the outer gas discharge path on the outer screw stator 41 side and the inner gas discharge path on the inner screw stator 51 side to communicate with each other. The gas path communication openings 76 are arrayed at equal intervals in the circumferential direction on the peripheral wall of the rotor lower cylindrical section 4B under the lowermost rotor blade 6.

As shown in FIG. 4, screw stator exhaust paths, i.e., screw stator exhaust openings 55 are arrayed at equal intervals in the circumferential direction on the bottom 52 of the inner screw stator 51. The screw stator exhaust openings 55 discharge gas that has been discharged by the outer screw groove 43 and the inner screw groove 53 to the exhaust opening 16*a* through the screw groove exhaust unit housing space. Gas that has passed through the outer gas discharge path and gas that has passed through the inner gas discharge path join together at the ends of the screw stators 41, 51. The gas is then guided to the exhaust port 16 disposed on the base 13 through the screw stator exhaust openings 55 formed on the inner screw stator 51 and the screw groove exhaust unit housing space.

(Outer Gas Discharge Path Length and Inner Gas Discharge Path Length)

As shown in FIG. 2, a length L1 between the upper surface of the outer screw stator 41 and the lower end of the rotor lower cylindrical section 4B in the axial direction (the outer screw stator effective length) is equal to a length L3 between the upper surface of the inner screw stator 51 and the lower end of the rotor lower cylindrical section 4B in the axial direction (the inner screw stator effective length).

Accordingly, the pressure on the upstream side of the outer screw stator 41 and the pressure on the upstream side of the inner screw stator 51 are made equal to each other. Thus, it is possible to prevent backflow of gas from an upstream side gas path on the inner screw stator 51 side to an upstream side gas path on the outer screw stator 41 side.

When the outer screw stator effective length L1 and the inner screw stator effective length L3 are equal to each other, the pressure on the upstream side of the outer screw stator 41 and the pressure on the upstream side of the inner screw stator 51 are equal to each other because of the following reason.

The exhaust performance of the turbo-molecular pump 100 is considered on the exhaust opening side.

Pressure on downstream side of screw stator: P0

Compression ratio of outer screw stator: Ko

Compression ratio of inner screw stator: Ki

Pressure on upstream side of outer screw stator: Po=Po/Ko

Pressure on upstream side of inner screw stator: Pi=Pi/Ki

Note that each of Ko and Ki depends on the angle of the screw, the screw stator effective length, and the like.

In the above, when the compression ratio of the outer screw stator is equal to the compression ratio of the inner screw stator, that is, Ko=Ki, the pressure at an inlet on the upstream side of the outer screw stator and the pressure at an inlet on the upstream side of the inner screw stator satisfy Po=Pi=Po/Ko.

That is, pressures on an outlet side of the turbine blade exhaust unit TP are made equal.

On the other hand, when the outer screw stator effective length L1 is larger than the inner screw stator effective length L3, for example, as illustrated in WO 2012/032863 A, Ko>Ki and Po<Pi are satisfied.

That is, gas on the upstream side of the inner screw stator flows to the upstream side of the outer screw stator.

This means that the amount of flow of gas discharged by the outer screw stator increases. As a result, reaction products are likely to be accumulated.

On the other hand, as described above, it is possible to prevent backflow of gas from the upstream side gas path on the inner screw stator 51 side to the upstream side gas path on the outer screw stator 41 side in the above embodiment. Thus, it is possible to reduce accumulation of reaction products.

As described above, making the outer screw stator effective length L1 equal to the inner screw stator effective length L3 is preferred. However, the outer screw stator effective length L1 may differ from the inner screw stator effective length L3.

(Discharge of Process Gas)

Figure 5:
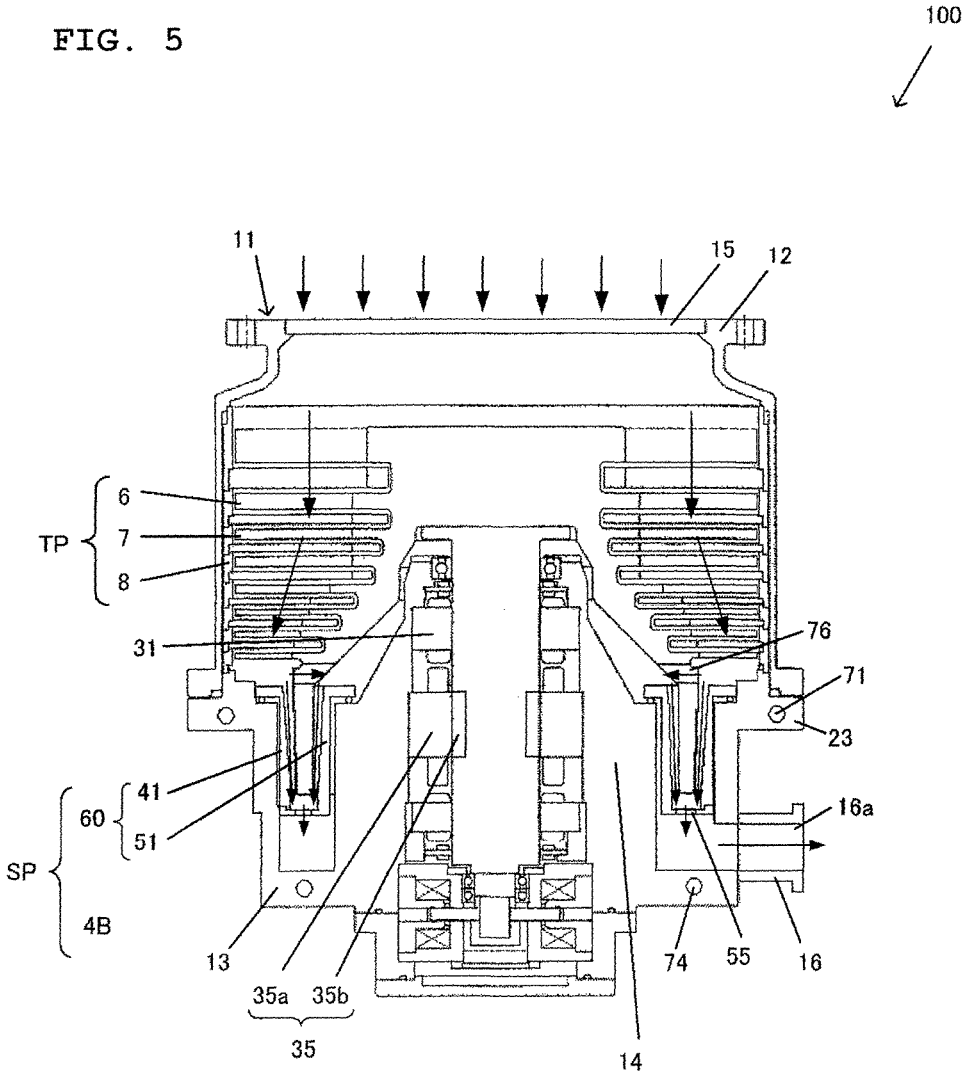
FIG. 5 is a diagram for illustrating the flow of gas in the turbo-molecular pump shown in FIG. 1.

FIG. 5 shows the flow of gas in the turbo-molecular pump 100 shown in FIG. 1.

A process gas that has been introduced through the suction opening 15 is compressed by the turbine blade exhaust unit TP, and then transferred to the screw groove exhaust unit SP which is provided with the screw stator 60. The transferred gas is divided to flow into the outer gas discharge path on the outer screw stator 41 side and the inner gas discharge path on the inner screw stator 51 side by the gas path communication openings 76 (refer to FIG. 3) formed on the upstream side of the screw stator 60. The divided gases are compressed when passing through the respective exhaust paths, then join together, and then guided to the exhaust opening 16*a* through the screw stator exhaust openings 55.

On the upstream side of the screw stator 60, the gas path on the outer screw stator 41 side is a straight path, whereas the gas path on the inner screw stator 51 side is a curved path via the gas path communication openings 76 formed on the rotor lower cylindrical section 4B. Thus, gas is likely to flow toward the outer screw stator 41. Therefore, a larger amount of gas is compressed on the outer screw stator 41. As a result, the temperature of the outer screw stator 41 is made higher than the inner screw stator 51 because of frictional heat.

When the outer screw stator effective length L1 is larger than the inner screw stator effective length L3, a further larger amount of gas flows through the outer gas discharge path. Thus, the temperature of the outer screw stator 41 is likely to further increase.

The action of aluminum chloride (AlCl3) as the process gas in the above embodiment will be described as an example.

When the pressure on the screw stator 60 is 100 Pa and the pressure on the upper part of the base 13 is 50 Pa, the sublimation temperature is approximately 80° C. in the screw stator 60 and approximately 50° C. in the upper part of the base 13, for example, near the inner side of the base upper flange 23.

The creep life upper limit temperature of the rotor 4 is, for example, approximately 120° C. to 130° C., and the flow amount of cooling water is determined so as to make the upper limit temperature of the upper part of the base 13 approximately 85° C. to 90° C. or less. That is, the amount of cooling water supplied to the base upper cooling pipe 71 is set taking into consideration temperature rise in the rotor 4 which may occur when a large amount of process gas flows. When the amount of process gas that has flown in a large amount decreases due to a process inside a vacuum processing chamber, the temperature of the upper part of the base 13 may become, for example, approximately 50° C. The outer screw stator 41 is thermally insulated from the base 13 by the heat insulation seal member 70A. Thus, even when the temperature of the base 13 drops to approximately 50° C., the temperature of the outer screw stator 41 is not likely to drop to the sublimation temperature of gas or less.

When a large amount of process gas is discharged, the temperature of the motor stator 35*a* also becomes high. At this point, the amount of coolant flowing through the base lower cooling pipe 74 is controlled to adjust the temperature of the motor stator 35*a* to a predetermined temperature or less.

The inner screw stator 51 is thermally insulated from the base 13, specifically, the central cylindrical section 14 by the heat insulation seal member 70B, and thus not affected by the cooling. As described above, a larger amount of process gas flows through the outer gas discharge path on the outer screw stator 41 side than the inner gas discharge path on the inner screw stator 51 side. Thus, the outer screw stator 41 has a higher temperature than the inner screw stator 51. The outer screw stator 41 and the inner screw stator 51 are thermally coupled to each other. Therefore, heat of the outer screw stator 41 is transmitted to the inner screw stator 51, thereby making it possible to maintain the inner screw stator 51 at a temperature equal to or higher than the sublimation temperature of reaction products.

When the amount of coolant supplied to the base upper cooling pipe 71 is controlled based on the temperature of the upper part of the base 13 so as not to be the creep life upper limit temperature or more, the temperature of the upper part of the base 13 may drop to the sublimation temperature of gas or less because of various reasons. Even in this case, the temperature of the outer screw stator 41 never drops to the sublimation temperature or less because the outer screw stator 41 is thermally insulated from the base 13.

As described above, the turbo-molecular pump 100 of the above embodiment achieves the following effects.

(1) The outer screw stator 41 and the inner screws stator 51 are thermally coupled to each other through the bottom 52. The amount of gas flowing through the outer gas discharge path is larger than the amount of gas flowing through the inner gas discharge path in the screw groove exhaust unit SP. Thus, temperature rise in the outer screw stator 41 caused by the gas flow is larger than that in the inner screw stator 51. Therefore, heat moves from the outer screw stator 41 to the inner screw stator 51 through the bottom 52 and the inner screw stator 51 is heated accordingly. As a result, it is possible to prevent accumulation of reaction products.

(2) When a large amount of gas is discharged when intermittently discharging gas or immediately after starting up the vacuum apparatus, the base 13, especially, the central cylindrical section 14 is cooled by cooling water flowing through the base lower cooling pipe 74. Thus, in a vacuum pump having a conventional structure, reaction products may rapidly increase in the inner gas discharge path, and a large amount of reaction products may be accumulated in a gap between the rotor lower cylindrical section 4B and the inner screw stator 51. As a result, in the vacuum pump having a conventional structure, the diameter of the rotor lower cylindrical section 4B that has increased due to centrifugal force during driving the pump may be reduced at the time of stopping the pump, and the rotor lower cylindrical section 4B may adhere to the reaction products accumulated on the inner screw stator 51, thereby causing trouble in restart of the pump.

In the vacuum pump of the first embodiment, the inner screw stator 51 is thermally insulated from the central cylindrical section 14 by the heat insulation seal member 70B. Thus, the temperature of the inner screw stator 51 is not affected by the temperature of the central cylindrical section 14. Therefore, it is possible to prevent stop of the pump caused by reaction products accumulated on the outer peripheral surface of the inner screw stator 51.

(3) In the vacuum pump of the first embodiment, the outer screw stator 41 is also thermally insulated from the upper flange 23 of the base 13 by the heat insulation seal member 70A. Thus, even when the temperature of the upper part of the base 13 is controlled to have a predetermined value or less, the outer screw stator 41 is not affected by the controlled temperature. Therefore, it is possible to make the temperature of the outer screw stator 41 equal to or higher than the sublimation temperature of gas.

(4) The outer screw stator effective length L1 is equal to the inner screw stator effective length L3. Thus, it is possible to prevent backflow of gas between the upstream side gas path on the inner screw stator 51 side and the upstream side gas path on the outer screw stator 41 side, and thereby reduce accumulation of reaction products caused by an increase in the amount of gas flowing through one of the gas paths caused by the backflow of gas.

Further, the amount of gas flowing through the outer gas discharge path becomes larger than the amount of gas flowing through the inner gas discharge path. Accordingly, the temperature of the outer screw stator 41 becomes higher than the temperature of the inner screw stator 51. However, the outer screw stator 41 is thermally coupled to the inner screw stator 51, which makes the temperature of the inner screw stator 51 equal to the temperature of the outer screw stator 41. Therefore, it is possible to suppress the amount of reaction products accumulated on the screw stator 60.

Second Embodiment

Figure 6:
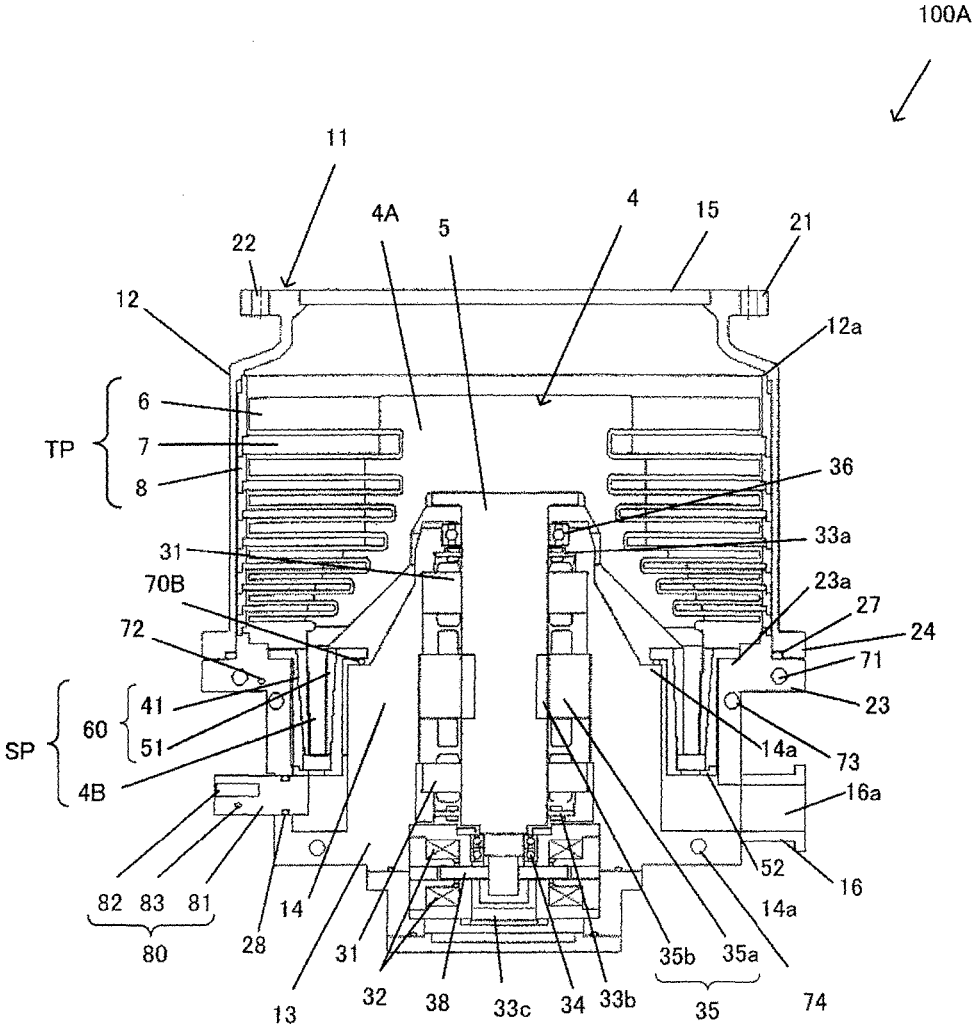
FIG. 6 is a cross-sectional view of a turbo-molecular pump as a second embodiment according to the present invention.

FIG. 6 is a cross-sectional view of a turbo-molecular pump 100A as a second embodiment according to the present invention.

The turbo-molecular pump 100A of the second embodiment differs from the turbo-molecular pump 100 of the first embodiment in the following (1) to (4).

(1) An outer screw stator 41 is thermally coupled to the upper part of a base 13.

(2) The turbo-molecular pump 100A is provided with a screw stator heating device 80 which raises the temperature of a screw stator 60.

(3) A base heating temperature sensor 72 is disposed on a base upper flange 23 formed on the upper part of the base 13.

(4) A base heating heater 73 is disposed in a region of the base 13, the region corresponding to the middle part of the screw stator 60.

Hereinafter, the turbo-molecular pump 100A of the second embodiment will be described mainly focusing on the above differences.

An inner screw stator 51 of the screw stator 60 is thermally insulated from a central cylindrical section 14 by a heat insulation seal member 70B in the same manner as in the first embodiment. However, the outer screw stator 41 is fixed to the upper part of the base 13 with a fastening member (not illustrated) and thermally coupled to the base 13.

The screw stator heating device 80 is disposed on the lower part of the base 13.

The screw stator heating device 80 is provided with a thermal conductive member 81, a screw stator heating heater 82, and a screw stator heating temperature sensor 83. The screw stator heating heater 82 and the screw stator heating temperature sensor 83 are attached to the thermal conductive member 81.

A through hole is formed on a side wall of the base 13. The through hole communicates with a screw groove exhaust unit housing space formed on the outer periphery of the central cylindrical section 14. The thermal conductive member 81 is fitted in the through hole on the side wall of the base 13 with a seal member 28 made of a heat insulation material interposed therebetween. The tip of the thermal conductive member 81 is in contact with a bottom 52 of the inner screw stator 51 and is thermally coupled to the inner screw stator 51. Thus, when the screw stator heating heater 82 is caused to generate heat, the stator 60 is heated through the thermal conductive member 81. The thermal conductive member 81 which is attached to the base 13 with the heat insulation seal member 28 interposed therebetween enables heat generated by the heater 82 to be efficiently transmitted to the screw stator 51.

The screw stator heating device 80 having such a configuration adjusts output of the stator heating heater 82 in accordance with a result detected by the stator heating temperature sensor 83 to thereby adjust the temperature of the outer stator 41 and the temperature of the inner stator 51.

One end of the thermal conductive member 81 projects from a peripheral wall of the base 13. The screw stator heating heater 82 and the screw stator heating temperature sensor 83 are disposed on the end of the thermal conductive member 81, that is, on the atmospheric side. The screw stator heating heater 82 and the stator heating temperature sensor 83 are connected to a control circuit unit (not illustrated) through a wiring member.

A structure in which the screw stator heating heater 82 and the screw stator heating temperature sensor 83 are disposed on the inner side of the base 13 may cause corrosion of a connected portion with the wiring member because of a process gas which is a chlorine-based or fluorine based corrosive gas. Thus, disposing the screw stator heating heater 82 and the screw stator heating temperature sensor 83 on the atmospheric side brings effects of improving the resistance to corrosion caused by the process gas in the connected portion and improving the reliability.

As described above, the base heating heater 73 and the base heating temperature sensor 72 are disposed on the base 13. The base heating heater 73 is turned on or off based on a base temperature detected by the base heating temperature sensor 72. For example, the base heating heater 73 is turned on to heat the base 13 when the temperature of the base 13 is low, for example, when intermittently discharging gas or immediately after staring up the vacuum apparatus. The amount of coolant flowing through a base upper cooling pipe 71 is controlled based on the base temperature detected by the base heating temperature sensor 72 to adjust the temperature of the rotor 4 to an appropriate temperature. A motor stator 35*a* of a motor 35 is cooled to have an appropriate temperature by coolant flowing through a base lower cooling pipe 74 in the same manner as in the first embodiment.

The other configurations are the same as those of the first embodiment. Thus, the same reference numerals designate corresponding elements, and description thereof will not be given.

In the second embodiment, it is possible to control each of the temperatures of the screw stator 60 and the upper part of the base 13 to the sublimation temperature of reaction products or more using the base heating heater 73, the base heating temperature sensor 72, and the screw stator heating device 80.

As an example, a case in which the sublimation temperature on the upper part of the base 13 is approximately 50° C. and the sublimation temperature on the outer screw stator 41 is 80° C. will be described.

When the temperature detected by the base heating temperature sensor 72 becomes a first predetermined temperature or less, that is, when a temperature that causes accumulation of reaction products on the upper part of the base 13 is detected, the base heating heater 73 is controlled to raise the temperature of the upper part of the base 13. When the temperature detected by the base heating temperature sensor 72 becomes a second predetermined temperature or more, that is, a temperature equal to or higher than the second predetermined temperature that is set based on the creep upper limit temperature of the rotor 4 is detected, the base heating heater 73 is controlled and, at the same time, the amount of coolant flowing through the base upper cooling pipe 71 is controlled to reduce the temperature of the upper part of the base 13. Accordingly, temperature rise in the rotor 4 is suppressed.

The screw stator heating device 80 controls the temperature of the screw stator 60 to the sublimation temperature of gas or more. For example, the screw stator heating temperature sensor 83 detects a temperature to control the temperature of the outer screw stator 41 to 80° C. or more. The outer screw stator 41 of the screw stator 60 is thermally coupled to the upper part of the base 13. The upper part of the base 13 is appropriately cooled by coolant flowing through the base upper cooling pipe 71, and the outer screw stator 41 is also cooled accordingly. However, as described above, the temperature of the outer screw stator 41 is appropriately adjusted by the screw stator heating device 80, and thus never drops to the sublimation temperature or less by the influence of the temperature of the base 13.

As described above, when the temperature of the motor stator 35*a* becomes high because of a large amount of discharged process gas, the amount of coolant flowing through the base lower cooling pipe 74 is controlled to adjust the temperature of the motor stator 35*a* to a predetermined temperature or less. Also in the second embodiment, the inner screw stator 51 of the screw stator 60 is thermally insulated from the central cylindrical section 14 by the heat insulation seal member 70B. Thus, when the base 13 is cooled, the inner screw stator 51 is not affected by the cooled central cylindrical section 14. Therefore, it is possible to maintain the inner screw stator 51 at a temperature that is equal to or higher than the sublimation temperature of reaction products.

When the central cylindrical section 14 of the base 13 is cooled by cooling water flowing through the base lower cooling pipe 74, an exhaust port 16 is also cooled accordingly. However, abase outer cylinder 13A is heated by the screw stator heating device 80, and the exhaust port 16 is also heated accordingly. Thus, it is possible to suppress accumulation of reaction products on the exhaust port 16.

In particular, disposing the screw stator heating device 80 near the exhaust opening 16*a* further reduces reaction products accumulated inside the exhaust port 16.

The turbo-molecular pump 100A of the second embodiment described above also achieves the same effects as obtained by the turbo-molecular pump 100 of the first embodiment.

Further, the turbo-molecular pump 100A of the second embodiment is provided with the screw stator heating device 80 for directly heating the screw stator 60 and maintaining the screw stator 60 at a predetermined temperature. Therefore, the second embodiment also has an effect capable of setting any target temperature corresponding to the sublimation temperature of the process gas to be discharged.

Third Embodiment

Figure 7:
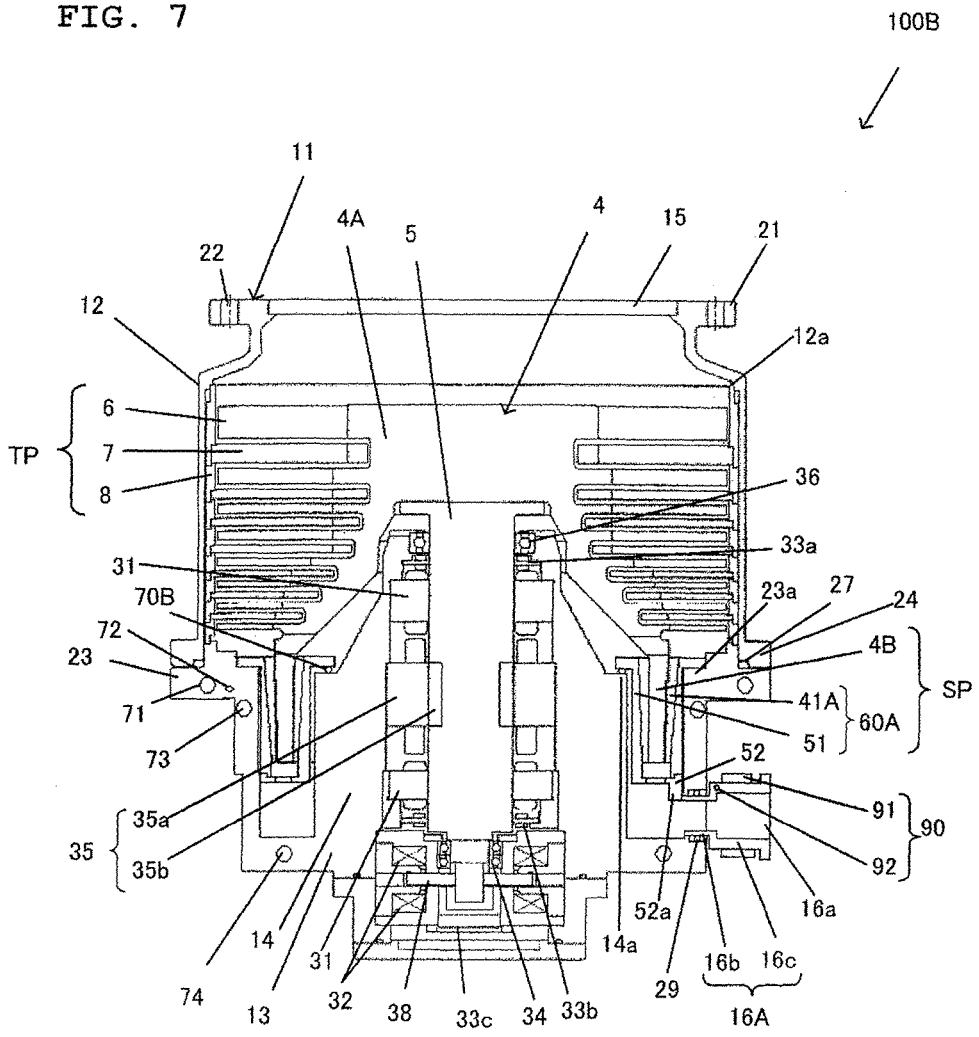
FIG. 7 is a cross-sectional view of a turbo-molecular pump as a third embodiment of the present invention.
Figure 8:
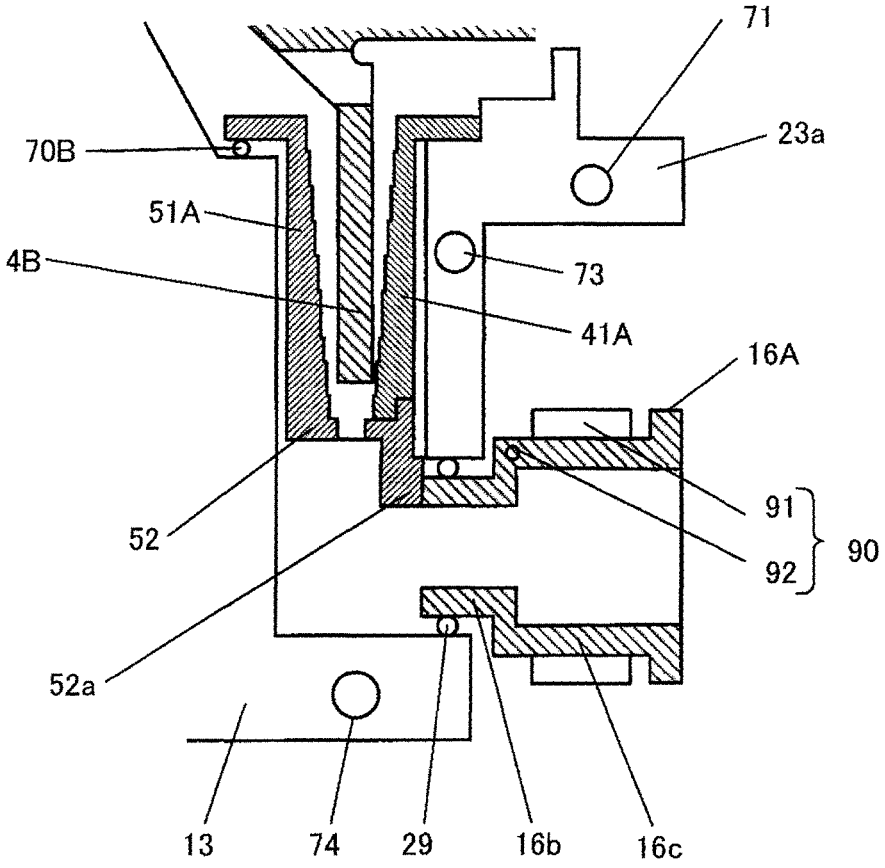
FIG. 8 is a detailed enlarged view of a screw stator 60 and an exhaust opening heating heater 91 shown in FIG. 7.

FIG. 7 is a cross-sectional view of a turbo-molecular pump 100B as a third embodiment according to the present invention. FIG. 8 is an enlarged view showing details of a screw stator 60 and an exhaust opening heating heater 91.

The turbo-molecular pump 100B of the third embodiment differs from the turbo-molecular pump 100A of the second embodiment in that a screw stator heating device 90 attached to an exhaust port 16A is provided instead of the screw stator heating device 80 of the second embodiment.

The screw stator heating device 90 is provided with a screw stator heating heater disposed on the outer periphery of the exhaust port 16A, i.e., an exhaust opening heating heater 91 and a screw stator heating temperature sensor disposed on the exhaust port 16A, i.e., an exhaust opening heating temperature sensor 92.

The exhaust port 16A has a stepped cylindrical shape having a small-diameter section 16*b* and a large-diameter section 16*c*. The small-diameter section 16*b* of the exhaust port 16A is fitted in a through hole formed on the base 13 with a heat insulation seal member 29 interposed therebetween. A projection piece 52*a* is formed on a bottom 52 of an inner screw stator 51A of the screw stator 60. The small-diameter section 16*b* of the exhaust port 16A is in direct contact with the projection piece 52*a* of the inner screw stator 51A and is thermally coupled to the screw stator 60A accordingly. The projection piece 52*a* is provided for the purpose of allowing the bottom 52 of the inner screw stator 51A to be in contact with the exhaust port 16A. Thus, the projection piece 52*a* is not required to be formed on the whole circumference of the annular screw stator 60A, and formed only near the exhaust port 16A.

The heat insulation seal member 29 prevents heat of the exhaust opening heating heater 91 from being transmitted to a base outer cylinder 13A. As a result, the heater has high efficiency.

The structure for thermally coupling the exhaust port 16A and the screw stator 60A to each other can be modified in various forms, for example, stacking and fixing the bottom 52 of the inner screw stator 51A and the small-diameter section 16*b* of the exhaust port 16A without providing the projection piece 52*a* in the inner screw stator 51A.

The other configurations are the same as those of the second embodiment. Thus, the same reference numerals designate corresponding elements, and description thereof will not be given.

In the third embodiment, when the exhaust opening heating heater 91 is caused to generate heat, the screw stator 60 is heated through the exhaust port 16A. In the third embodiment, the exhaust port 16A also serves as the thermal conductive member 81 of the second embodiment.

In the third embodiment, each of the temperatures of the screw stator 60 and the upper part of the base 13 is controlled to the sublimation temperature of reaction products or more using coolant flowing through a base upper cooling pipe 71, a base heating heater 73, a base heating temperature sensor 72, and the screw stator heating device 90. The screw stator heating device 90 has the same function as the screw stator heating device 80 of the second embodiment.

Therefore, the turbo-molecular pump 100B of the third embodiment achieves the same effect as achieved by the turbo-molecular pump 100A of the second embodiment.

In the third embodiment, the screw stator heating device 90 is attached to the exhaust port 16A. Further, an exhaust port provided in a common turbo-molecular pump can be applied to the exhaust port 16A merely with slight modification. Therefore, the third embodiment has an effect capable of obtaining superiority in cost.

Each of the embodiments descried above can be modified in the following manner.

(1) The structure in which the screw stator exhaust openings 55 are formed on the bottom 52 of the inner screw stator 51 has been described as an example in each of the above embodiments. However, the bottom of the outer screw stator 41 may extend toward the inner screw stator 51 to be thermally coupled to the inner screw stator 51. Further, the screw stator exhaust openings 55 may be formed on the extending part of the outer screw stator 41.

(2) An integrated screw stator 60 which includes the outer screw stator 41 and the inner screw stator 51 coupled together on the bottom thereof may be produced, for example, by casting. Further, the screw stator exhaust openings 55 may be formed on the bottom.

(3) In each of the above embodiments, the outer screw groove 43 and the inner screw groove 53 are formed on the screw stator 60. However, the outer screw groove 43 and the inner screw groove 53 may be formed on the rotor lower cylindrical section 4B. A screw groove may be formed on only one side surface of the exhaust path, or screw grooves may be formed both side surfaces of the exhaust path.

(4) The base heating temperature sensor 72 and the base heating heater 73 described in the second embodiment may be provided in the vacuum pump of the first embodiment.

(5) In each of the above embodiments, an active magnetic bearing turbo-molecular pump has been described as an example. However, the present invention can also be applied, for example, to passive magnetic bearing turbo-molecular pumps using a permanent magnet or turbo-molecular pumps using a mechanical bearing.

(6) The present invention can be applied not only to turbo-molecular pumps, but also to various vacuum pumps which drive a rotor to rotate by a motor to perform evacuation. Thus, the present invention can also be applied to vacuum pumps having only a screw groove exhaust unit. In this case, the rotor upper cylindrical section 4A may be omitted.

(7) In each of the embodiments, the base 13 in which the base outer cylinder and the central cylindrical section 14 are integrated has been described. However, the base outer cylinder and the central cylindrical section 14 may be formed as separate members and integrated with each other with a fastening member, for example, a bolt.

The present invention can be modified in various forms within the scope of the invention. Therefore, the present invention can be applied to various vacuum pumps that include a screw groove exhaust unit having a rotor cylindrical section and a stator wherein an outer stator and an inner stator of the screw groove exhaust unit are thermally coupled to each other.

What is claimed is:

1. A vacuum pump that discharges gas that has been sucked through a suction opening, the vacuum pump comprising:

a screw groove exhaust section including a rotor cylindrical section and a stator; a base constituting a part of a pump container and including a central cylindrical section and an outer cylindrical section;

a rotor having the rotor cylindrical section;

an inner stator forming an inner gas discharge path of the screw groove exhaust section between an inner peripheral surface of the rotor cylindrical section and the inner stator, wherein the inner stator comprises a flange formed on an upper part thereof;

an outer stator forming an outer gas discharge path of the screw groove exhaust section between an outer peripheral surface of the rotor cylindrical section and the outer stator, and being thermally coupled to the inner stator by connection to the inner stator not via the base, such that heat from the outer stator is transferred to the inner stator through a bottom portion of the outer stator and a bottom portion of the inner stator;

a communication opening formed on the rotor, and allowing the outer gas discharge path and the inner gas discharge path to communicate with each other on an upstream side;

an exhaust opening discharging joined gas of the gas passing through the outer gas discharge path and the gas passing through the inner gas discharge path from the screw groove exhaust section toward an exhaust port; and a base cooling device for cooling the base, wherein the flange of the inner stator extends over and is held on an upper surface of a step which is formed on a middle part in the axial direction of the central cylindrical section with a heat insulator interposed therebetween and wherein the inner stator does not directly contact the central cylindrical section so as to be thermally insulated from the central cylindrical section which is cooled by the base cooling device.

2. The vacuum pump according to claim 1, wherein the outer stator is held on the outer cylindrical section with or without a heat insulator interposed therebetween.

3. The vacuum pump according to claim 1, wherein the inner stator and the outer stator are cylindrical members having different diameters, the cylindrical members are thermally connected to each other on a downstream side of the gas discharge paths, and the exhaust opening of the screw groove exhaust section is formed on the thermally connected portion.

4. The vacuum pump according to claim 1, wherein a motor stator of a motor that drives the rotor to rotate is disposed on the central cylindrical section, and the base cooling device includes a lower base cooling device that cools the central cylindrical section.

5. The vacuum pump according to claim 4, further comprising a turbine blade exhaust section apart from the screw groove exhaust section, wherein the base cooling device includes an upper base cooling device that cools the turbine blade exhaust section.

6. The vacuum pump according to claim 1, further comprising a stator heating device, wherein the stator heating device includes a stator heating heater for raising a temperature of the outer stator and a stator heating temperature sensor for detecting the temperature of the outer stator, and adjusts output of the stator heating heater in accordance with a result detected by the stator heating temperature sensor to adjust the temperature of the outer stator and a temperature of the inner stator.

7. The vacuum pump according to claim 6, wherein the stator heating device further includes a thermal conductive member attached to the base with a seal member interposed therebetween, and the stator heating heater and the stator heating temperature sensor are disposed on the thermal conductive member.

8. The vacuum pump according to claim 1, wherein a length in an axial direction of the outer stator and a length in an axial direction of the inner stator are equal to each other in the screw groove exhaust section.

* * * * *